US005375434A

United States Patent [19]

Wertheimer et al.

[11] Patent Number: 5,375,434

[45] Date of Patent: Dec. 27, 1994

[54] REMOVABLE JEWELRY STONE SETTING

[75] Inventors: Jacob Wertheimer, Lawrence; Jeffrey N. Alpert, Bayside, both of N.Y.

[73] Assignee: Yanni's Creations, Inc., New York, N.Y.

[21] Appl. No.: 161,158

[22] Filed: Dec. 3, 1993

[51] Int. Cl.[5] ..... A44C 17/02

[52] U.S. Cl. ..... 63/29.1; 63/15

[58] Field of Search ..... 63/29.1, 26, 30, 15

[56] References Cited

U.S. PATENT DOCUMENTS

| | | | |
|---|---|---|---|
| 367,449 | 8/1887 | Scott | 63/29.1 |
| 1,536,365 | 5/1925 | Wiseman | 63/26 |
| 2,147,740 | 2/1939 | Gruber | 63/29.1 |
| 3,115,758 | 12/1963 | Eberle et al. | 63/29.1 |
| 3,307,375' | 3/1967 | Estrin et al. | 63/29.1 |
| 3,543,535 | 12/1970 | Siegel et al. | 63/29.1 |
| 4,488,415 | 12/1984 | Jenkins | 63/29.1 |
| 4,742,696 | 5/1988 | Jenkins | 63/29.1 |
| 5,022,238 | 6/1991 | German | 63/29.1 |
| 5,133,195 | 7/1992 | Appelbaum et al. | 63/29.1 |

*Primary Examiner*—Michael J. Milano
*Attorney, Agent, or Firm*—Lilling & Lilling

[57] ABSTRACT

The removable jewelry stone setting includes a cover that is pivoted on a finger of the setting to permit the removal and replacement of the jewelry stone. A link is pivotally connected to the other end the cover. At the other end of the link, a lock is pivotally connected to the link and its other end is removably frictionally engaged to the finger. In this way, by releasing the friction fit of the tab of the lock against the finger, the lock and link can be released, so as to permit the pivotal movement of the cover, so as to permit the removal and replacement of the jewelry stone.

5 Claims, 2 Drawing Sheets

REMOVABLE JEWELRY STONE SETTING

FIELD OF THE INVENTION

The invention relates to the jewelry industry and, in particular, to a locking device that easily permits the removal and replacement of a stone in a jewelry setting.

BACKGROUND OF THE INVENTION

Jewelry with different types of stone settings have been in existence for many millenniums. Stone settings have been popular in rings, earrings, bracelets, necklaces, brooches and generally all types of jewelry. In most cases, the stones are permanently mounted in the setting on the piece of jewelry and cannot be easily removed.

Known in the prior art are reversible stone settings. These settings do not permit the easy removal and replacement of a stone, however. Instead, they permit the setting to be pivoted or rotated, so that another surface of the stone is visible. This permits versatility in the jewelry in that it permits a two-colored stone to be selectively visible on either side, but these settings do not permit the easy substitution of one stone for another.

There is a need in the industry for a simple to use setting that will permit the simple removal and replacement of a jewelry stone. Such a device is not known to exist in the jewelry industry.

SUMMARY OF THE INVENTION

The invention relates to a simple to use jewelry setting that permits the easy removal and replacement of the jewelry stone. This unique jewelry setting may be used in rings, earrings and generally any type of jewelry that includes a setting for a stone.

The invention resides in a conventional setting for a stone, which additionally includes a cover, a link and a locking means. The cover fits over the stone and is mounted so as to pivot about its resting point. Thus, it can be raised and lowered to hold the stone in place and to permit its removal. A link is connected to the other end of the cover and a locking means is connected to the other end of the link. The locking means wraps around underneath the setting and is frictionally held in place. By this simple means, the stone can be held securely in the setting, but, by releasing the frictional fit of the lock, the cover can be easily lifted to remove and replace the jewelry stone.

DETAILED DESCRIPTION OF THE INVENTION

Figure 1:
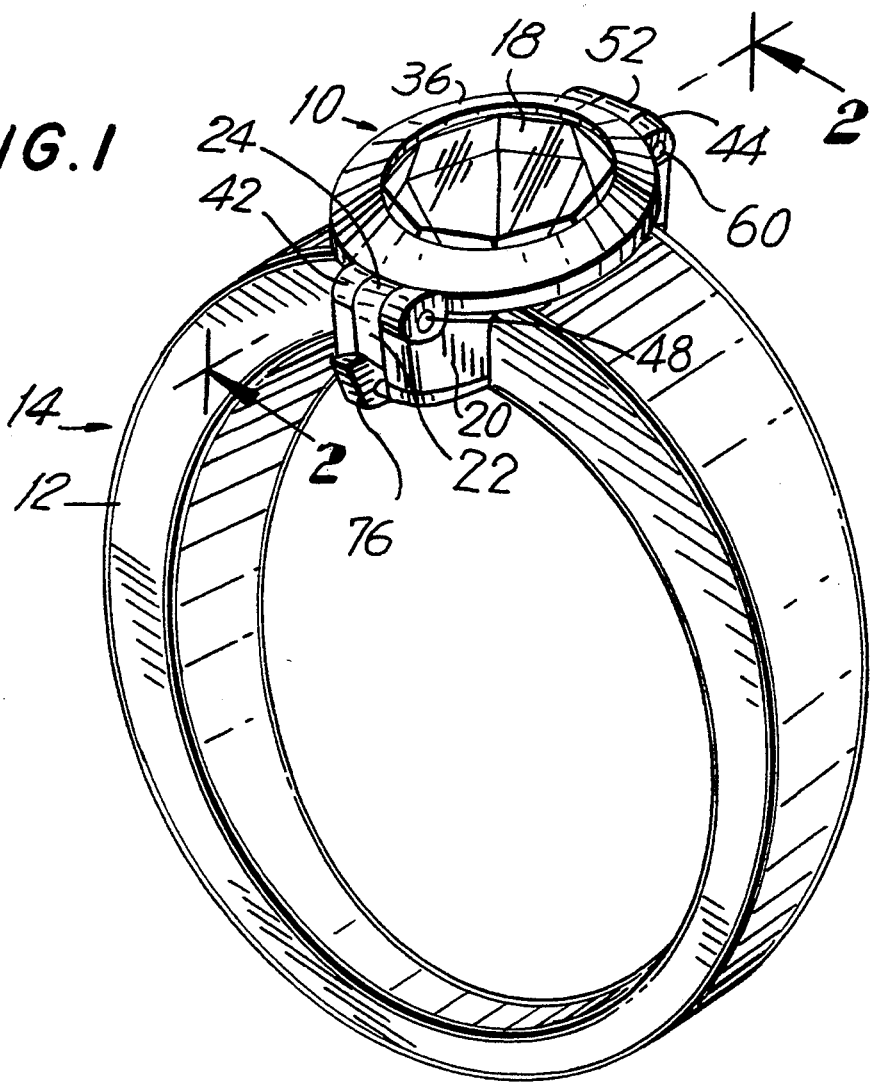
FIG. 1 is a perspective view of the fully assembled removable jewelry stone setting of this invention
Figure 2:
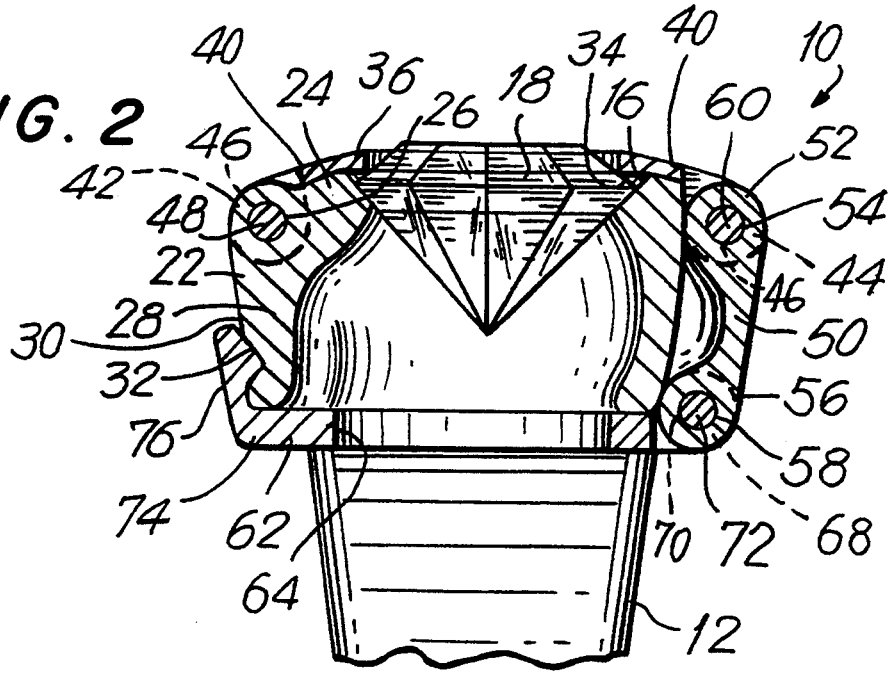
FIG. 2 is a cross sectional view taken along line 2—2 of FIG. 1.
Figure 3:
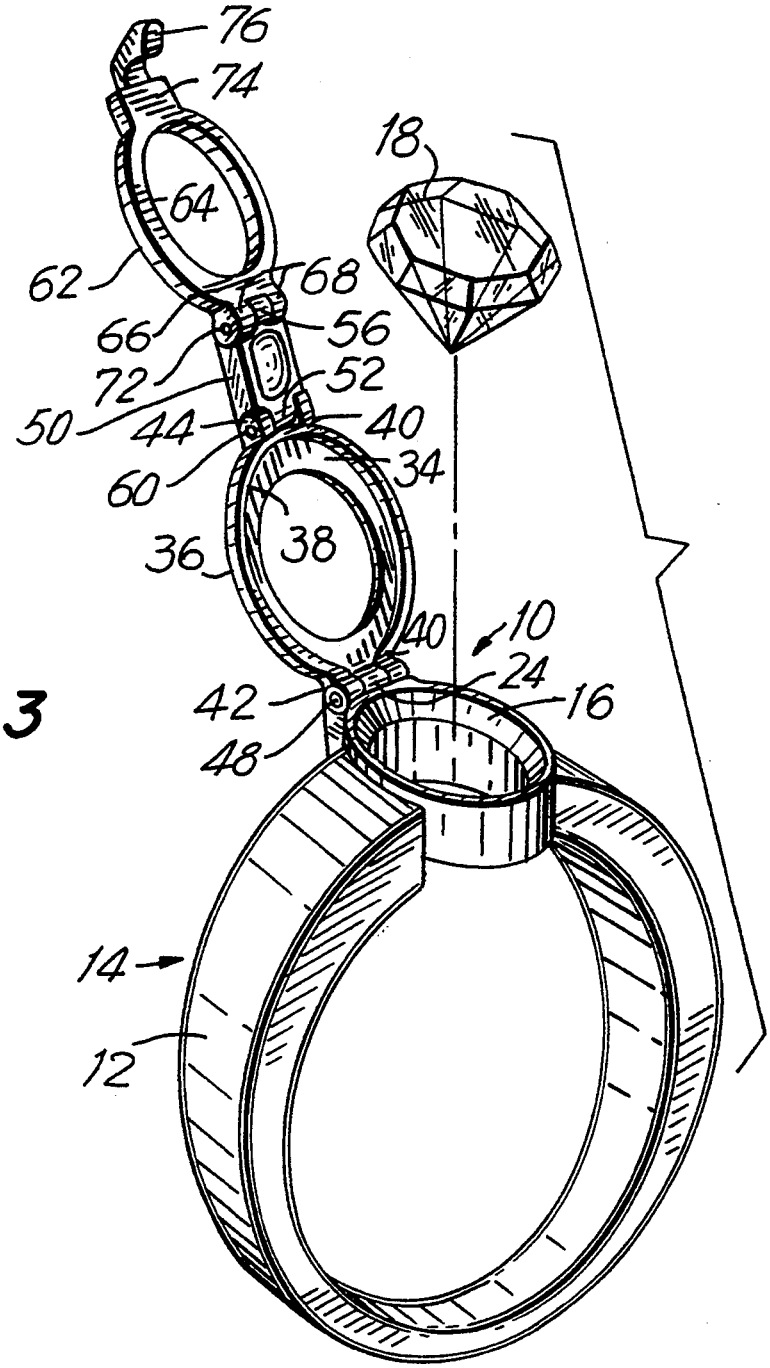
FIG. 3 is an exploded perspective view of the invention.

The jewelry setting 10 of this invention is shown, in the preferred embodiment, as being mounted on the shank 12 of a ring 14. It may be appreciated, however, that it may also be fitted on earrings, brooches, necklaces and any other type of jewelry that requires a setting for a jewelry stone.

The setting 10 includes an inclined cylindrical shoulder 16 that defines the seat for the jewelry stone 18. The jewelry stone may be any conventional shaped jewelry stone, such as a marquis, pear or diamond shape. Further, the stone can be any material, such as a diamond, ruby, sapphire or any other precious or semi-precious jewelry stone. Similarly, the setting can be any conventional setting of any conventional material, such as metal, plastic, ceramic, bone or any other suitable material. The invention will work with any conventional setting with any conventional stone.

Mounted on one of the external side 20 of the setting 10 is an upstanding finger 22 with a rounded top end 24. Through the top of the rounded end 24 of the finger 22 is a through opening 26. Near the bottom 28 of the finger 22, on the outer surface 30, there is an indentation 32. The finger 22 is generally made integral with the setting 10, but could be affixed to the setting by adhesives or welding or any suitable means.

The undersurface 34 of the cover 36 has a cylindrical (or oval) inclined wall that defines a seat 38. It is intended to sit over the top portion (or crown) of the stone 18 and to hold it in place against the setting 10. On each end 40 of the cover 36 there are parallel opposed eyes 42 and 44 with through holes or openings 46. The eyes 42 fit around the rounded end 24 on the top of the finger 22 and the openings 46 are in alignment with the through opening 26. A pivot pin 48 is then passed through the openings and it secures the cover to the finger. In this way, the cover can be pivoted about the finger to permit its opening and closing.

The link 50 includes through openings 54 and 58 at its top 52 and bottom 56. The top 52 of the link 50 is placed between the eyes 44 on the end 40 of the cover 36 and the openings 46 are in alignment with the openings 54 in the top 52 of the link 50. A pivot pin 60 is then passed through the openings to secure the link and cover together. This will also permit the pivotal movement of the cover and link with respect to each other.

The locking means 62 has a central circular (or oval) section 64. On one end 66 are opposed parallel eyes 68 with through openings 70. The lower end 56 of the link 50 is placed between the eyes 68 of the lock 62 and the openings 58 at the lower end 56 of the link 50 are in alignment with the openings 70 of the eyes 68 of the lock 62. A pivot pin 72 is used to hold the link and the lock together. Extending upward from the planar surface 74 of the lock 62 is an upstanding tab 76. This is meant for engagement with the indentation 32 on the lower end 28 of the finger 22.

With the cover 36 in a raised position, a stone 18 is placed in the setting 10. Then, the cover 36 pivots about the finger 22 and closes over the stone 18 to hold it in place. The link 50 is then pivoted along the side of the setting and the lock 62 is then pivoted along the undersurface of the setting 10 and the tab 76 at the end of the lock 62 engages the indentation 32 on the finger 22 to frictionally hold the entire mechanism in place. In this manner, the stone is held securely in place.

To remove the stone, the tab 76 on the lock 62 is pushed downward to release it from the indentation 32 on the finger 22. This permits the free movement of the lock and the link and permits the cover to be raised, to permit the removal of the stone and the replacement with another stone.

The invention is described in detail with reference to particular embodiments, but it should be understood that various other modifications can be effected and still be within the spirit and scope of the invention.

We claim:

1. A removable jewelry stone setting comprising:

a finger affixed to an outer surface of said setting;

a cover pivotally mounted on said finger for removably securing said stone in said setting;

a link pivotally connected to said cover;

and a locking means pivotally connected to said link and removably engaging said finger.

2. A removably jewelry stone setting according to claim 1, wherein said finger includes an upper rounded end with a through opening and a lower portion of said finger includes an indentation.

3. A removably jewelry stone setting according to claim 2, wherein said cover includes a first pair of eyes with openings in alignment with said through opening on said finger; and further comprising a pin connecting said openings in said eyes of said cover with said through hole and said finger.

4. A removable jewelry stone setting according to claim 3, wherein said link includes openings in alignment with openings in a second pair of eyes of said cover; and further comprising a pin connecting said openings in said link with said openings in said second pair of eyes of said cover.

5. A removable jewelry stone setting according to claim 4, wherein said locking means includes a pair of eyes with openings that are in alignment with a second opening in said link and comprises a tab that removably engages said indentation on said finger; and further comprising a pin that connects said openings in said eyes of said locking means with said second opening of said link.

* * * * *